US009728015B2

(12) United States Patent
Kwak

(10) Patent No.: US 9,728,015 B2
(45) Date of Patent: Aug. 8, 2017

(54) FUEL SAVINGS SCORING SYSTEM WITH REMOTE REAL-TIME VEHICLE OBD MONITORING

(71) Applicant: TrueLite Trace, Inc., Cupertino, CA (US)

(72) Inventor: Sung Bok Kwak, Cupertino, CA (US)

(73) Assignee: Truelite Trace, Inc., Milpitas, CA (US)

( * ) Notice: Subject to any disclaimer, the term of this patent is extended or adjusted under 35 U.S.C. 154(b) by 127 days.

(21) Appl. No.: 14/515,456

(22) Filed: Oct. 15, 2014

(65) Prior Publication Data

US 2016/0110935 A1 Apr. 21, 2016

(51) Int. Cl.
*G07C 5/00* (2006.01)
*G07C 5/08* (2006.01)
*G06Q 50/06* (2012.01)

(52) U.S. Cl.
CPC ..... *G07C 5/0808* (2013.01); *G06Q 50/06* (2013.01); *G07C 5/008* (2013.01); *G07C 5/085* (2013.01)

(58) Field of Classification Search
None
See application file for complete search history.

(56) References Cited

U.S. PATENT DOCUMENTS 8,498,792 B2 7/2013 Abboud et al.
8,508,354 B2 8/2013 Harumoto et al.
8,548,670 B2 10/2013 Harumoto et al.
2007/0027593 A1* 2/2007 Shah ..... B60W 50/00 701/29.4
2010/0214089 A1 8/2010 Giuli
2013/0046449 A1* 2/2013 Yucel ..... F16H 61/0213 701/51
2013/0046526 A1* 2/2013 Yucel ..... G01C 21/3469 703/8
2013/0253782 A1* 9/2013 Saltsman ..... G06F 17/00 701/51
2015/0134226 A1* 5/2015 Palmer ..... B60W 40/10 701/101
2015/0199360 A1* 7/2015 Pfeiffer ..... G06Q 50/02 707/723
(Continued)

*Primary Examiner* — Truc M Do
*Assistant Examiner* — Jess Whittington
(74) *Attorney, Agent, or Firm* — Invent Capture, LLC.; Samuel S. Cho

(57) ABSTRACT

A novel fuel savings scoring system is capable of analyzing real-time on-board diagnostics (OBD) information of a vehicle from a remote monitoring station unit. The fuel savings scoring system can derive a novel fuel efficiency comparison metric called "driving score." Preferably, the driving score represents a commercial vehicle driver's fuel efficiency driving performance relative to those of peer commercial drivers in a commercial vehicle fleet organization. The driving score takes account of a current real-time mileage achieved by a particular vehicle as well as the best empirical mileage achieved by the same make and model to the particular vehicle in the commercial vehicle fleet organization. Furthermore, in some embodiments of the invention, the driving score for the particular vehicle can even be route and traffic condition-sensitive, which further improves the realistic usefulness of the driving score as a comparative fuel efficiency driving performance measure among commercial vehicle drivers.

12 Claims, 5 Drawing Sheets

Components of Fuel Efficiency Improvement Factors in a Commercial Vehicle

(56) References Cited

U.S. PATENT DOCUMENTS

| | | | | |
|---|---|---|---|---|
| 2015/0199630 | A1* | 7/2015 | Pfeiffer | G06Q 10/0639 707/722 |
| 2015/0199637 | A1* | 7/2015 | Pfeiffer | G06Q 50/02 705/7.39 |
| 2015/0199775 | A1* | 7/2015 | Pfeiffer | G06Q 10/06398 705/7.42 |
| 2016/0078391 | A1* | 3/2016 | Blank | G06Q 10/06398 705/7.42 |

* cited by examiner

An Embodiment of a Fuel Savings Scoring System with a Remote Real-Time Vehicle OBD Monitoring

100

A System Block Diagram Example for a Vehicle-Side Commercial Vehicle Fuel Consumption Analytics Module

200

EQ. 301

$$\text{Driving Score} = \frac{\text{Current Mileage by a Particular Vehicle}}{\text{Best Empirical Mileage Achieved by the Same Type \& Model of the Vehicle in a Commercial Fleet}} \times 100$$

An Equation for a Novel Concept of "Driving Score"

FIG. 3

| **Mechanical and Physical Improvement Factors:** |
| --- |
| Tire Rolling Resistance, Aerodynamic Drag, Engine Tune-up, Fuel Injection System Cleaning, and etc. |

401

| **Non-Mechanical Improvement Factors:** |
| --- |
| A) Traffic and Environmental Condition |
| B) Driver Habits (Speed, Acceleration, Idling) |

402

Components of Fuel Efficiency Improvement Factors in a Commercial Vehicle

FIG. 4

An Example of Improved Fuel Economy in a Commercial Vehicle Relative to Time

600

FUEL SAVINGS SCORING SYSTEM WITH REMOTE REAL-TIME VEHICLE OBD MONITORING

BACKGROUND OF THE INVENTION

The present invention generally relates to vehicle fuel efficiency improvement and related vehicle information management methods and systems. More specifically, various embodiments of the present invention relate to a fuel savings scoring system with remote real-time vehicle onboard diagnostics monitoring.

A significant fuel cost increase in transport vehicles and a newfound socioeconomic interest in energy efficiency in the last several decades have placed fuel efficiency a top priority in the commercial vehicle management industry. Even though newer engine designs and vehicle design improvements provide incrementally-higher fuel efficiencies in commercial trucks and other fleet vehicles, many vehicle operational factors, such as drivers' driving habits, traffic conditions, and vehicle maintenance and aftermarket fuel efficiency optimizations, cause over thirty percent variability in fuel efficiency of commercial vehicle operations.

To place the importance of the fuel efficiency variability in context, a commercial vehicle fleet operator of ten trucks, with each truck averaging 15 miles per gallon, can achieve over 19.5 miles per gallon (i.e. a thirty percent improvement), if some of the vehicle operational factors are optimized. Because a truck in a commercial vehicle fleet routinely incurs several thousand dollars per month in fuel costs, a thirty percent improvement in fuel efficiency results in hundreds of dollars in fuel savings per month, for one truck alone. For the commercial vehicle fleet operator of ten trucks, following the above example, the fuel cost savings can accumulate to thousands of dollars per month.

Despite significant cost saving potential from improved fuel efficiency by optimizing aftermarket vehicle parts and drivers' driving behaviors, conventional methods of fuel efficiency improvement methods in the commercial trucking and vehicle fleet industry have been unsystematic and disjointed at best. For example, in conventional attempts to improve fuel efficiency, a truck driver may be encouraged to accelerate or decelerate more gently by a commercial trucking company. The commercial trucking company may also issue guidelines to its employees to drive under a recommended speed limit for optimal fuel efficiency. Furthermore, another conventional method of attempting fuel savings is simply displaying an auto manufacturer-implemented fuel efficiency number on a vehicle's dashboard, which is typically expressed as miles per gallon (MPG) or kilometers per liter (km/l). Unfortunately, these conventional fuel efficiency improvement efforts tend to be overly incoherent and sporadic, thereby failing to be effective strategies in most vehicle fleet operations. Furthermore, in case of a company ownership of trucks and commercial vehicles, a driver of a commercial vehicle may not have sufficient incentive or motivation to attempt fuel saving optimizations during his or her vehicular journey in the first place.

Therefore, it may be desirable to devise a novel electronic system that enables a commercial vehicle operator to track, manage, and improve fuel efficiency of its fleet vehicles in operation with a centralized electronic infrastructure. Furthermore, it may also be desirable to devise a novel electronic system that enables each commercial vehicle driver to understand a vehicle's current fuel efficiency relative to peer vehicles, and improve the fuel efficiency of commercial vehicles by optimizing driving events, habits, and behaviors.

Moreover, it may also be desirable to devise a fuel savings scoring system and a novel graphical representation of the fuel savings progress to motivate both commercial vehicle operating entities and commercial vehicle drivers to improve fleet vehicle fuel efficiencies through mechanical improvement factors as well as non-mechanical improvement factors.

SUMMARY

Summary and Abstract summarize some aspects of the present invention. Simplifications or omissions may have been made to avoid obscuring the purpose of the Summary or the Abstract. These simplifications or omissions are not intended to limit the scope of the present invention.

In one embodiment of the invention, a fuel savings scoring system with a remote real-time vehicle on-board diagnostics monitoring is disclosed. This fuel savings scoring system comprises: a vehicle on-board diagnostics unit connected to an engine control unit or a vehicular control chipset of a vehicle to record, diagnose, and generate engine, vehicle dynamics, and fuel consumption data as a real-time data stream; a commercial vehicle fuel consumption analytics module that receives the real-time data stream from the vehicle on-board diagnostics unit, while also receiving best empirical mileage data achieved by the vehicle itself or a peer vehicle of same model and make from a commercial fleet fuel consumption database associated with a commercial vehicle fleet company; a fuel savings score analytics unit in the commercial vehicle fuel consumption analytics module, wherein the fuel savings score analytics unit calculates a driving score by dividing a current fuel mileage of the vehicle by a best empirical mileage number achieved by the vehicle itself or by the peer vehicle of same model and make, and then multiplying by 100; the commercial fleet fuel consumption database that accumulates, stores, and categorizes fuel consumption records downloaded from the vehicle and a plurality of peer vehicles of same model and make; and a computer server or another electronic device with a CPU and a memory unit that executes the fuel savings score analytics unit and the commercial fleet fuel consumption database to calculate and display the driving score on a display panel in the vehicle or in a remote monitoring station unit.

BRIEF DESCRIPTION OF DRAWINGS

FIG. 3 shows an equation for a novel concept of "driving score," in accordance with an embodiment of the invention.

FIG. 4 shows components of fuel efficiency improvement factors in a commercial vehicle, in accordance with an embodiment of the invention.

DETAILED DESCRIPTION

Figure 1:
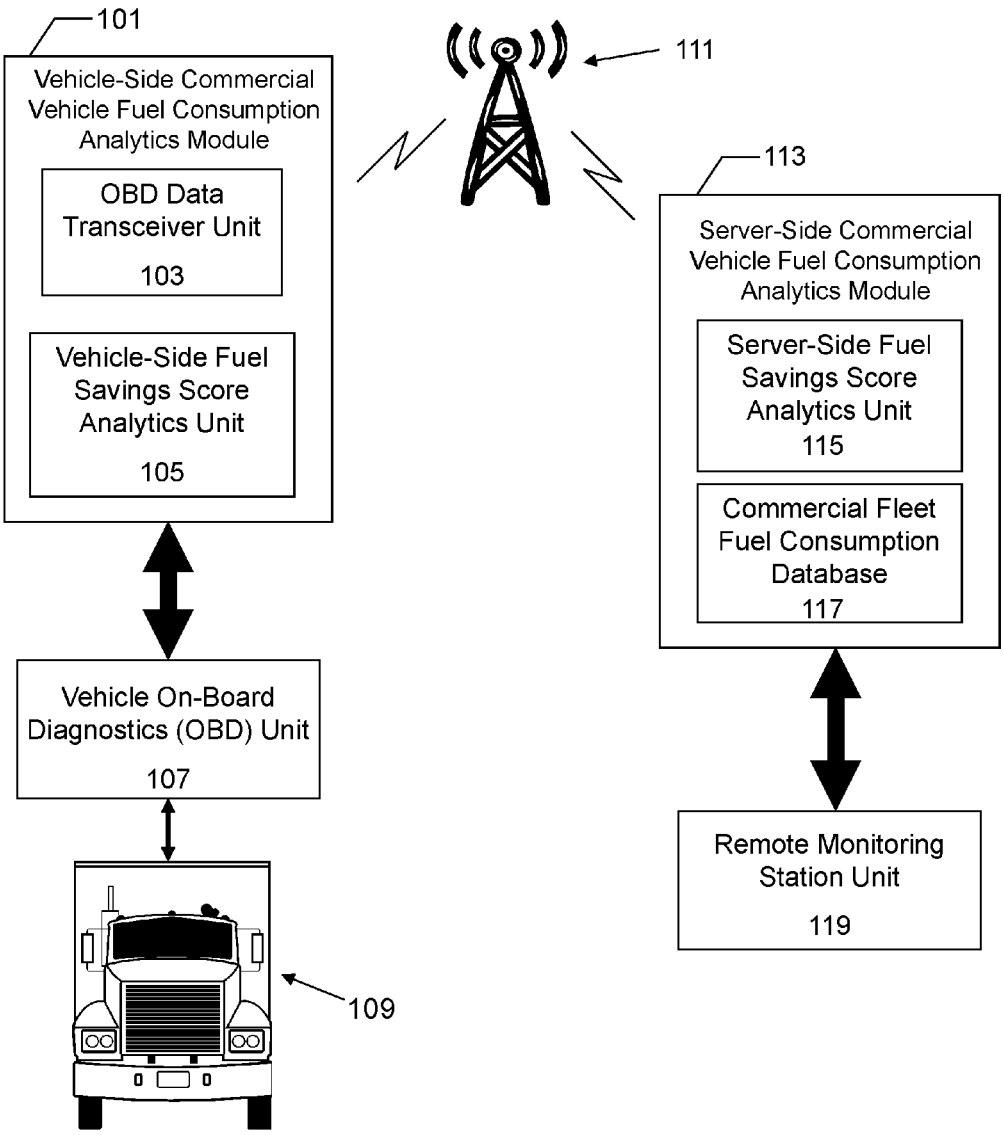
FIG. 1 shows a novel fuel savings scoring system with a remote real-time vehicle onboard diagnostics monitoring, in accordance with an embodiment of the invention.

Specific embodiments of the invention will now be described in detail with reference to the accompanying figures. Like elements in the various figures are denoted by like reference numerals for consistency.

In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

The detailed description is presented largely in terms of description of shapes, configurations, and/or other symbolic representations that directly or indirectly resemble one or more fuel savings scoring system with remote real-time vehicle onboard diagnostics monitoring, or methods of operating such novel systems. These descriptions and representations are the means used by those experienced or skilled in the art to most effectively convey the substance of their work to others skilled in the art.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment. Furthermore, separate or alternative embodiments are not necessarily mutually exclusive of other embodiments. Moreover, the order of blocks in process flowcharts or diagrams representing one or more embodiments of the invention do not inherently indicate any particular order nor imply any limitations in the invention.

For the purpose of describing the invention, a term "onboard vehicle monitoring device" is defined as an electronic device installed in a vehicle to collect and/or analyze a variety of vehicle-related data. In one example, a vehicle's onboard computer outputs many data parameters in real-time, such as vehicle diagnostic information (e.g. engine temperature, oil level, OBD codes, and etc.), speed information, engine rotation-per-minute (RPM) information, fuel levels, and miles driven relative to time. These data parameters can be part of the vehicle-related data collected and analyzed by a vehicle-side commercial vehicle fuel consumption analytics module and/or a server-side commercial vehicle fuel consumption analytics module.

In addition, for the purpose of describing the invention, a term "mileage" is defined as fuel efficiency of a vehicle.

Moreover, for the purpose of describing the invention, a term "empirical mileage" is defined as a real-life operation fuel efficiency by a driver in street road conditions, as opposed to a mere theoretical fuel efficiency or a government agency-tested fuel efficiency number.

Furthermore, for the purpose of describing the invention, a term "commercial vehicle fuel consumption analytics module" is defined as an electronic sub-system, which at least comprises a fuel savings score analytics unit, a data communication unit, a memory unit, and a central processing unit (CPU). In a preferred embodiment of the invention, this electronic subs-system is part of a fuel savings scoring system with a remote real-time vehicle OBD monitoring, wherein the fuel savings scoring system further comprises a vehicle on-board diagnostics (OBD) unit, a wireless communication network, a computer server, a commercial fleet fuel consumption database, and a computerized user interface to enable a remote real-time vehicle OBD monitoring. Furthermore, the commercial vehicle fuel consumption analytics module may be implemented inside a vehicle (i.e. vehicle-side fuel savings score analytics unit), inside a remote monitoring station unit connected to a computer server (i.e. server-side fuel savings score analytics unit), or both.

In addition, for the purpose of describing the invention, a term "driver's user interface" is defined as a computerized user interface with a display, which is connected to a vehicle-side commercial vehicle fuel consumption analytics module. The computerized user interface may be configured to display a driver's "driving score" or any other fuel efficiency-related information, such as driving score trends.

Moreover, for the purpose of describing the invention, a term "driving score" is defined as a numerical indicator of a driver's current fuel efficiency driving performance relative to an empirically-best fuel efficiency driving performance achieved previously by the driver or by a peer driver in a same commercial vehicle fleet organization. In a preferred embodiment of the invention, the driving score is calculated by a current mileage (i.e. fuel efficiency) by a particular vehicle divided by the best empirical mileage achieved by the same type and model of the particular vehicle in a commercial fleet, which is then multiplied by 100. A higher driving score generally indicates more fuel efficient driving than a lower driving score. Preferably, the best empirical mileage achieved by the same type and model of the particular vehicle in the commercial fleet is specific to an identical route and a similar traffic condition experienced by the particular vehicle, so that the driving score is a fair and accurate numerical indicator of the driver's current fuel efficiency driving performance, compared to the best of the peer drivers who have driven the same route under the similar traffic condition.

Furthermore, for the purpose of describing the invention, a term "remote monitoring station unit" is defined as a vehicle fleet monitoring location for one or more commercial vehicles in operation. Examples of remote monitoring station units include, but are not limited to, a commercial vehicle operation control center, a vehicle monitoring service center, and an fleet vehicle employer's information technology (IT) control center.

In addition, for the purpose of describing the invention, a term "computer server" is defined as a physical computer system, another hardware device, a software module executed in an electronic device, or a combination thereof. For example, in context of an embodiment of the invention, a "computer server" is dedicated to executing one or more computer programs for receiving, processing, and analyzing fuel consumption-related OBD input data, and generating, calculating, and displaying fuel savings score-related analysis and information output. Furthermore, in one embodiment of the invention, a computer server is connected to one or more data networks, such as a local area network (LAN), a wide area network (WAN), a cellular network, and the Internet. Moreover, a computer server can be used by a vehicle monitoring personnel for gathering and analyzing fuel consumption-related OBD input data and also for generating and calculating fuel savings score-related analysis and information output.

One aspect of an embodiment of the present invention is providing a novel electronic system that enables a commercial vehicle operator to track, manage, and improve fuel efficiency of its fleet vehicles in operation with a centralized electronic infrastructure.

Another aspect of an embodiment of the present invention is providing a novel electronic system that enables each commercial vehicle driver to understand a vehicle's current fuel efficiency relative to peer vehicles, and improve the fuel efficiency of commercial vehicles by optimizing driving events, habits, and behaviors.

Yet another aspect of an embodiment of the present invention is providing a fuel savings scoring system and a novel metric called the "driving score" for measuring a driver's fuel efficiency driving performance relative to the best of the driver's own past records and driver's peer records under a similar route and a similar traffic condition.

Furthermore, another aspect of an embodiment of the present invention is providing a novel graphical representation of the fuel savings progress to motivate both commercial vehicle operating entities and commercial vehicle drivers to improve fleet vehicle fuel efficiencies through mechanical improvement factors as well as non-mechanical improvement factors.

FIG. 1 shows a novel fuel savings scoring system (100) with a remote real-time vehicle onboard diagnostics monitoring, in accordance with an embodiment of the invention. In this preferred embodiment of the invention, the fuel savings scoring system (100) comprises a vehicle-side commercial vehicle fuel consumption analytics module (101), a vehicle on-board diagnostics (OBD) unit (107), a data communication network (111), a server-side commercial vehicle fuel consumption analytics module (113), and a remote monitoring station unit (119). In the preferred embodiment of the invention, the vehicle-side commercial vehicle fuel consumption analytics module (101) includes an OBD data transceiver unit (103) and a vehicle-side fuel savings score analytics unit (105). Furthermore, the server-side commercial vehicle fuel consumption analytics module (113) includes a server-side fuel savings score analytics unit (115) and a commercial fleet fuel consumption database (117), as shown in FIG. 1. Moreover, the data communication network (111) may include at least one of a cellular communication network, a satellite communication network, a land-mobile radio communication network, or a combination thereof.

In the preferred embodiment of the invention, the vehicle OBD unit (107) is installed inside a commercial vehicle (109), such as a truck, a van, a taxi, or another commercial fleet vehicle. The vehicle OBD unit (107) is also typically connected to an engine control unit and other vehicular control chipsets to record, diagnose, and generate a variety of engine, vehicle dynamics, and fuel consumption data as a real-time data stream. This real-time data stream from the vehicle OBD unit (107) can be transmitted locally inside the commercial vehicle (109) to the vehicle-side commercial vehicle fuel consumption analytics module (101), which in turn analyzes the real-time data stream to calculate one or more metrics for a driver's current fuel efficiency driving performance. At least one of the metrics calculated for the driver's current fuel efficiency driving performance is a novel fuel efficiency driving performance metric called the "driving score," in accordance with an embodiment of the invention.

The "driving score" is defined as a numerical indicator of the driver's current fuel efficiency driving performance relative to an empirically-best fuel efficiency driving performance achieved previously by the driver or by a peer driver in a same commercial vehicle fleet organization. In order to calculate the driving score for a particular commercial vehicle (e.g. 109), it is desirable to store and access a dynamically-updated fuel efficiency driving performance dataset for a multiple number of commercial fleet vehicles, so that the empirically-best fuel efficiency driving performance achieved previously by the driver of the particular commercial vehicle (e.g. 109) or by a peer driver in the same commercial vehicle fleet organization can be tracked and utilized for accurate calculation of the driving score. In the preferred embodiment of the invention as shown in FIG. 1, the dynamically-updated fuel efficiency driving performance dataset for the multiple number of commercial fleet vehicles is stored, updated, and categorized by vehicle models and makes in the commercial fleet fuel consumption database (117), which is typically operated and executed by a computer server located in the remote monitoring station unit (119). Furthermore, the commercial fleet fuel consumption database (117) may also store, update, and categorize the dynamically-updated fuel efficiency driving performance dataset by driving routes and traffic conditions.

Continuing with FIG. 1, in one embodiment of the invention, the vehicle-side commercial vehicle fuel consumption analytics module (101) may request and receive a relevant portion of the dynamically-updated fuel efficiency driving performance dataset from the commercial fleet fuel consumption database (117) through the data communication network (111), in order to calculate the driving score in the vehicle-side fuel savings score analytics unit (105). In another embodiment of the invention, the driving score may be calculated entirely by the server-side fuel savings score analytics unit (115) after the real-time data stream from the vehicle OBD unit (107) is wirelessly transmitted to the server-side commercial vehicle fuel consumption analytics module (113) via the OBD data transceiver unit (103) and the data communication network (111). If the server-side fuel savings score analytics unit (115) is performing all of the analysis and the calculations associated with the driving score, it may be unnecessary to implement the vehicle-side fuel savings score analytics unit (105) in such instances. Yet in another embodiment of the invention, some of the driving score and related fuel efficiency driving performance calculations are performed inside the commercial vehicle (109) by the vehicle-side commercial vehicle fuel consumption analytics module (101), while some other portions of the driving score and related fuel efficiency driving performance calculations are performed by the server-side commercial vehicle fuel consumption analytics module (113). In such instances, the separate calculations from the vehicle-side commercial vehicle fuel consumption analytics module (101) and the server-side commercial vehicle fuel consumption analytics module (113) may be combined or shared through the data communication network (111).

Furthermore, as shown in FIG. 1, the remote monitoring station unit (119) is a vehicle fleet monitoring location for one or more commercial vehicles in operation. In the preferred embodiment of the invention, the remote monitoring station unit (119) may be a commercial vehicle operation control center, a vehicle monitoring service center, or an fleet vehicle employer's information technology (IT) control center that also houses a computer server for executing and operating the server-side commercial vehicle fuel consumption analytics module (113), including its components such as the server-side fuel savings score analytics unit (115) and the commercial fleet fuel consumption database (117). For a seamless operation of the fuel savings scoring system with the remote real-time OBD monitoring, a monitoring station personnel in the remote monitoring station unit (119) may access, view, and/or control vehicle fuel efficiency-related information that are analyzed, calculated, and generated by the server-side commercial vehicle fuel consumption analytics module (113) and the computer server.

Figure 2:
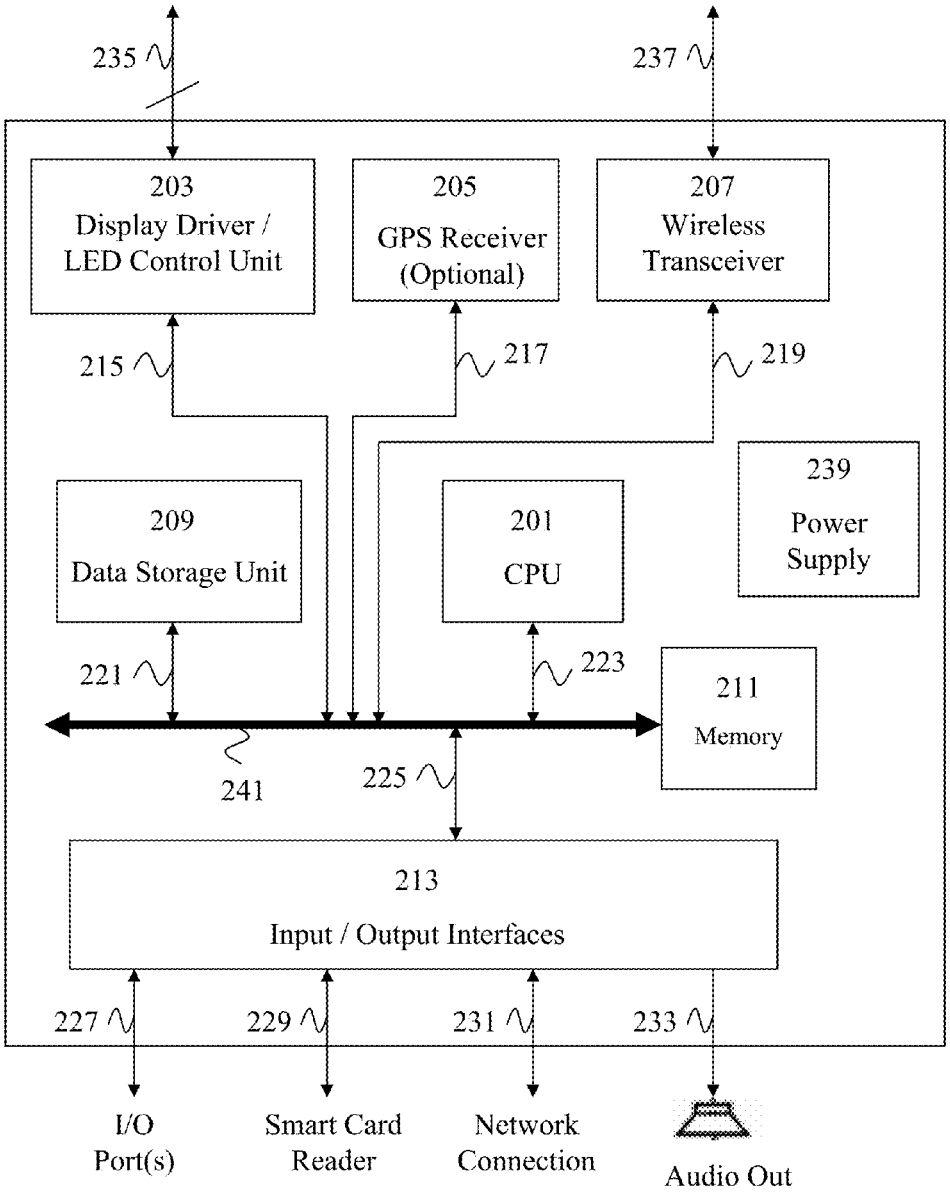
FIG. 2 shows a system block diagram example for a vehicle-side commercial vehicle fuel consumption analytics module, in accordance with an embodiment of the invention.

FIG. 2 shows a system block diagram example (200) for a vehicle-side commercial vehicle fuel consumption analytics module (e.g. 101 of FIG. 1), in accordance with an embodiment of the invention. In this system block diagram example, the vehicle-side commercial vehicle fuel consumption analytics module includes a CPU (201), a memory unit (211), a data storage unit (209), a display driver and/or LED control unit (203), a wireless transceiver (207), an input/output interfaces (213), and a power supply (239). Optionally, the vehicle-side commercial vehicle fuel consumption analytics module also has a global positioning system (GPS) receiver (205).

In one embodiment of the invention, these hardware system blocks (e.g. 200) for the vehicle-side commercial vehicle fuel consumption analytics module are configured to execute a vehicle-side fuel savings score analytics unit (e.g. 105 of FIG. 1) in the CPU (201) and the memory unit (211). In another embodiment of the invention, the vehicle-side fuel savings score analytics unit (e.g. 105 of FIG. 1) may be hard-coded into a semiconductor chip as a hardware component within the hardware system blocks of the vehicle-side commercial vehicle fuel consumption analytics module (e.g. 101 of FIG. 1). Furthermore, the wireless transceiver (207) in the system block diagram example (200) for the vehicle-side commercial vehicle fuel consumption analytics module (e.g. 101 of FIG. 1) can function as an OBD data transceiver unit (e.g. 103 of FIG. 1), with a wireless data communication interface (237). The wireless transceiver (207) may be configured to transmit or receive data packets via a cellular network, a satellite network, a land-mobile radio network, or via another wireless communication method.

Continuing with FIG. 2, the data storage unit (209) in the vehicle-side commercial vehicle fuel consumption analytics module can store OBD data streams from a vehicle OBD unit and any information retrieved from a commercial fleet fuel consumption database. Furthermore, the vehicle-side fuel savings score analytics unit executed in the hardware system blocks (i.e. the CPU (201) and the memory unit (211)) of the vehicle-side commercial vehicle fuel consumption analytics module can retrieve the OBD data streams and the commercial fleet fuel consumption information from the data storage unit (209) to calculate a real-time driving score for a driver of a commercial vehicle. In addition, the display driver and/or LED control unit (203) can provide fuel efficiency and driving score-related graphics information to a display panel or to a plurality of LED indicator lights through a display driver output (235).

Furthermore, in one embodiment of the invention, the GPS receiver (205) in the vehicle-side commercial vehicle fuel consumption analytics module may be utilized to record and synchronize GPS location information with the OBD data streams for combining the real-time route and/or traffic condition information of the commercial vehicle with the real-time fuel efficiency information associated with the driver of the commercial vehicle. Moreover, various hardware components (i.e. 201, 203, 205, 207, 209, 211, 213, 239) of the vehicle-side commercial vehicle fuel consumption analytics module can transmit and receive data among each other via an internal bus (241) and various electrical connections (215, 217, 219, 221, 223, 225).

In the embodiment of the invention as shown in FIG. 2, the vehicle-side commercial vehicle fuel consumption analytics module also includes the power supply unit (239), which supplies electrical power to various hardware components (i.e. 201, 203, 205, 207, 209, 211, 213, 239) in the hardware system blocks of the vehicle-side commercial vehicle fuel consumption analytics module. Furthermore, the vehicle-side commercial vehicle fuel consumption analytics module may also include the input/output interfaces (213) that can accommodate data communication for I/O ports (227), smart card readers (229), network connections (231), and an audio out connection (233) to a speaker. As shown in the system block diagram example (200), in this embodiment of the invention, the input/output interfaces (213) are operatively connected to the internal bus (241), which can communicate with any other components in the vehicle-side commercial vehicle fuel consumption analytics module.

FIG. 3 shows an equation (EQ. 301) for a novel concept of "driving score," in accordance with an embodiment of the invention. In a preferred embodiment of the invention, the equation (EQ. 301) for calculating the driving score is defined as the current mileage by a particular vehicle divided by the best empirical mileage achieved by a vehicle of the same type, the make, and the model in a commercial fleet, which is then multiplied by 100, as shown in FIG. 3.

For example, if a vehicle currently being analyzed by a commercial vehicle fuel consumption analytics module (i.e. vehicle-side, server-side, or both) and a remote monitoring station unit has a real-time fuel mileage of 14 MPG, while the best empirical mileage achieved by a vehicle of the same make and model in the commercial fleet is 20 MPG, then the driving score for the vehicle currently being analyzed is 70 out of 100 (i.e. 14 divided by 20 multiplied by 100). In this example, the best achievable driving score is 100 based on the best empirical mileage achieved by a vehicle of the same make and model in the commercial fleet, and a particular driving score indicates (e.g. 70 out of 100) how close a driver's fuel efficiency performance is to the best empirical mileage.

The novel "driving score" concept disclosed herein in accordance with the preferred embodiment of the invention is a unique comparative approach to evaluate a commercial vehicle driver's fuel efficiency driving performance against the best of the past fuel efficiency records achieved by the driver's own records or peers' records who drive the same make and model. In some instances, the best of the past fuel efficiency records may have been established by the commercial vehicle driver himself or herself.

Furthermore, in one embodiment of the invention, the best empirical mileage achieved by a vehicle of the same make and model in the commercial fleet may be an absolute "best" empirical mileage regardless of driving routes and traffic conditions. In another embodiment of the invention, the best empirical mileage achieved by a vehicle of the same make and model in the commercial fleet may be a variable number based on similarities of routes and/or traffic conditions between the best empirical mileage and the current mileage achieved by the particular vehicle under the fuel consumption and efficiency analysis.

FIG. 4 shows components of fuel efficiency improvement factors in a commercial vehicle, in accordance with an embodiment of the invention. In a preferred embodiment of the invention, the fuel efficiency improvement factors comprise mechanical and physical improvement factors (401) and non-mechanical improvement factors (402), as shown in FIG. 4. Some of the mechanical and physical improvement factors (401) that can improve fuel efficiency in an aftermarket upgrade include, but are not limited to, tire rolling resistance, aerodynamic drag, engine tune-up, and fuel injection system cleaning.

For example, a commercial vehicle that installs lower inertia tires may be able to achieve a higher fuel efficiency by reducing the tire rolling resistance. Furthermore, the commercial vehicle may also improve fuel efficiency by installing aerodynamic body kits on its chassis, which reduces air drag coefficient. The reduction in air drag coefficient with such aerodynamic body kits becomes especially significant if the commercial vehicle is cruising at high speeds for a substantial portion of its operation. Moreover, if the commercial vehicle is an aging vehicle, an engine tune-up can reduce unnecessary internal frictions inside the aging vehicle's engine, thereby also improving fuel efficiency of the commercial vehicle. Similarly, periodically performing the fuel injection system cleaning in the commercial vehicle may also reduce unnecessary internal frictions in the commercial vehicle's powertrain, which in turn also improves fuel efficiency.

In the preferred embodiment of the invention, these types of aftermarket mechanical and physical upgrades can realistically be supported by vehicle owners and/or fleet vehicle operators. Therefore, in context of the preferred embodiment of the invention, the vehicle owners and/or the fleet vehicle operators can routinely check commercial vehicle drivers' "driving scores," which are calculated using the equation (i.e. EQ. 301) and the method previously described. Then, if the commercial vehicle owners and/or the fleet vehicle operators want to systematically improve the physical and mechanical aspects of the commercial vehicles for increased fuel efficiency, the commercial vehicle owners and/or the fleet vehicle operators can make capital commitments in purchasing and installing aftermarket parts, such as lower inertia tires and aerodynamic body kits. Likewise, the commercial vehicle owners and/or the fleet vehicle operators can also make capital commitments in fuel efficiency-related aftermarket vehicle services, such as engine tune-ups and fuel injection system cleaning, to increase the overall vehicle fuel efficiency. In general, the commercial vehicle owners and/or the fleet vehicle operators can directly control the mechanical and physical improvement factors (401), but the non-mechanical improvement factors (402) are largely dependent upon each driver's driving behavior, particular routes, and traffic conditions.

As also shown in FIG. 4, the non-mechanical improvement factors (402) comprise traffic and environmental conditions and driver habits. Examples of traffic and environmental conditions include, but are not limited to, road congestion levels (e.g. stop-and-go rush hour traffic, emergency road blockade, free-flowing traffic, and etc.), varying road elevations (i.e. winding mountain roads, near sea-level straight roads, and etc.), outside air temperature during a vehicle's operation, and frequencies of left turns and right turns to get to the destination. In some instances, the driver may have some discretionary control over the traffic and environmental conditions. For example, the driver can choose a less congested route, avoid rush hours if possible, and also avoid winding and mountainous road if there is a compelling alternate route in order to maximize fuel efficiency. The level of driver control for fuel efficiency is even more significant in case of the driver habits. The driver has a direct control of speed, acceleration, braking, and idling, all of which contribute to inefficient or efficient fuel usage for the commercial vehicle. Therefore, by checking a real-time "driving score" in the commercial vehicle displayed through a display panel connected to the vehicle-side commercial vehicle fuel consumption analytics module, the driver can be motivated to make necessary adjustments and optimizations related to the non-mechanical improvement factors (402) for increasing the fuel efficiency of the commercial vehicle.

In a commercial vehicle fleet organization, each driver of a commercial vehicle may even be politically and/or financially motivated by a corporate policy that issues promotions or bonuses, based on a daily, weekly, monthly, quarterly, or yearly-averaged number of each driver's driving score. For example, if there is $5,000 total fuel savings in the commercial vehicle fleet organization in August compared to the previous month (i.e. July), or the same month of the previous year (i.e. August of last year), a corporate policy may reward one or more drivers with high driving scores by issuing monthly bonuses that are set to be 30% of the overall fuel savings per month. In this case, the fuel savings objective can be reset annually or periodically to continue to improve the overall fuel efficiency driving performance over time in the commercial vehicle fleet organization. Furthermore, the commercial vehicle fleet organization can accurately and objectively track its employees' (e.g. drivers') driving scores over time, and make appropriate staffing decisions based on each employee's performance.

Figure 5:
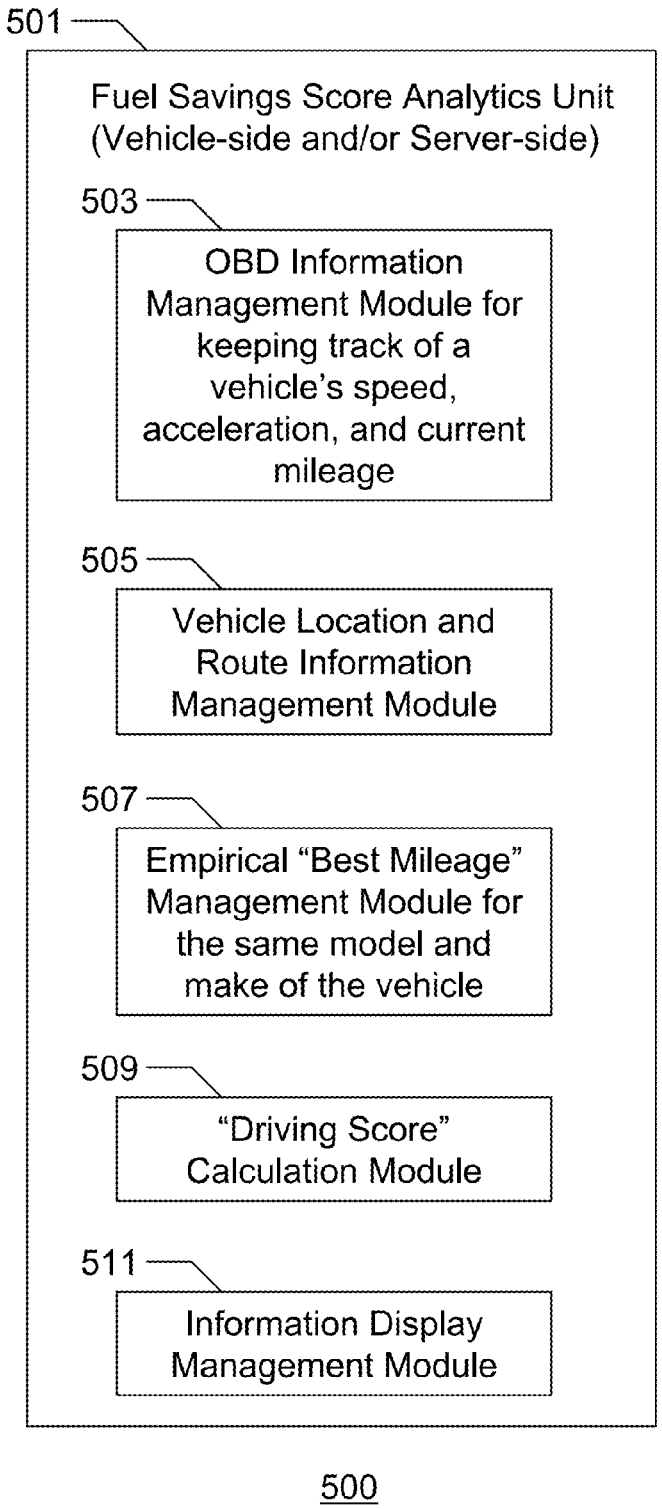
FIG. 5 shows a fuel savings score analytics unit, in accordance with an embodiment of the invention.

FIG. 5 shows an example (500) of internal components of a fuel savings score analytics unit (501), in accordance with an embodiment of the invention. The fuel savings score analytics unit (501) may be in a vehicle side, a server side, or both, as previously shown and described for elements 105 and 115. In a preferred embodiment of the invention, the fuel savings score analytics unit (501) comprises an OBD information management module (503) for keeping track of a vehicle's speed, acceleration, and current mileage. An OBD data stream which contains vehicular dynamics and fuel consumption information can be stored, categorized, and extracted in the OBD information management module (503).

The fuel savings score analytics unit (501) also includes a vehicle location and route information management module (505). The vehicle location and route information management module (505) is capable of tracking, categorizing, and storing vehicle location and route information, which may be retrieved from a GPS receiver unit or another location tracking unit. Preferably, the vehicle location and route information are combined, time-stamped, and/or time-synchronized with the OBD data stream coming from a vehicle OBD unit. Furthermore, as shown in FIG. 5, the fuel savings score analytics unit (501) also includes an empirical "best mileage" management module (507) for a same model and make of the vehicle. In one example, a commercial fleet fuel consumption database stores and maintains fuel consumption information, vehicle efficiency information, and driving scores for a plurality of vehicles registered with a commercial vehicle fleet organization. The empirical "best mileage" management module (507) is able to request and retrieve at least a portion of these information from the commercial fleet fuel consumption database to extract and identify an appropriate "best empirical mileage" number for calculating a driving score for a particular vehicle.

Continuing with FIG. 5, the fuel savings score analytics unit (501) also includes a "driving score" calculation module (509), which may utilize EQ. 301 or another appropriate equation to calculate the driving score. The numerator in EQ. 301, or the "current mileage by a particular vehicle," is retrieved from the OBD information management module (503), while the denominator in EQ. 301, or the "best empirical mileage" by the same make and model in a commercial fleet, is retrieved from the empirical "best mileage" management module (507). In the preferred embodiment of the invention, the location and route information from the vehicle location and route information management module (505) may also be considered for calculation of the driving score in order to retrieve the appropriate "best mileage" number. If the best mileage number is a variable that correlates to a particular driving route and/or a traffic condition, the resulting driving score is even more realistic and accurate by incorporating route and traffic condition-dependencies in its calculation. In another embodiment of the invention, the best mileage number is simply the absolute best record number for the same model and make of the particular vehicle for the driving score calculation, which may simplify implementation of the fuel savings scoring system with the remote real-time vehicle OBD monitoring.

Moreover, the fuel savings score analytics unit (501) also includes an information display management module (511). The information display management module (511) is configured to display the driving score and any related fuel efficiency and consumption metrics, such as driving score trends, to a display panel in the particular vehicle or in the remote monitoring station unit. In one embodiment of the invention, the fuel savings score analytics unit (501) may be a software unit, which is executed in a CPU and a memory unit of a hardware device, such as system block components (e.g. 200 of FIG. 2) of a commercial vehicle fuel consumption analytics module. In another embodiment of the invention, the fuel savings score analytics unit (501) may be a combination of software units and hardware units that conceptually constitute various components (503, 505, 507, 509, 511) of the fuel savings score analytics unit (501). Yet in another embodiment of the invention, the fuel savings score analytics unit (501) may be entirely implemented into a semiconductor chip, which makes the fuel savings score analytics unit (501) a system-on-chip (SoC) hardware solution.

Figure 6:
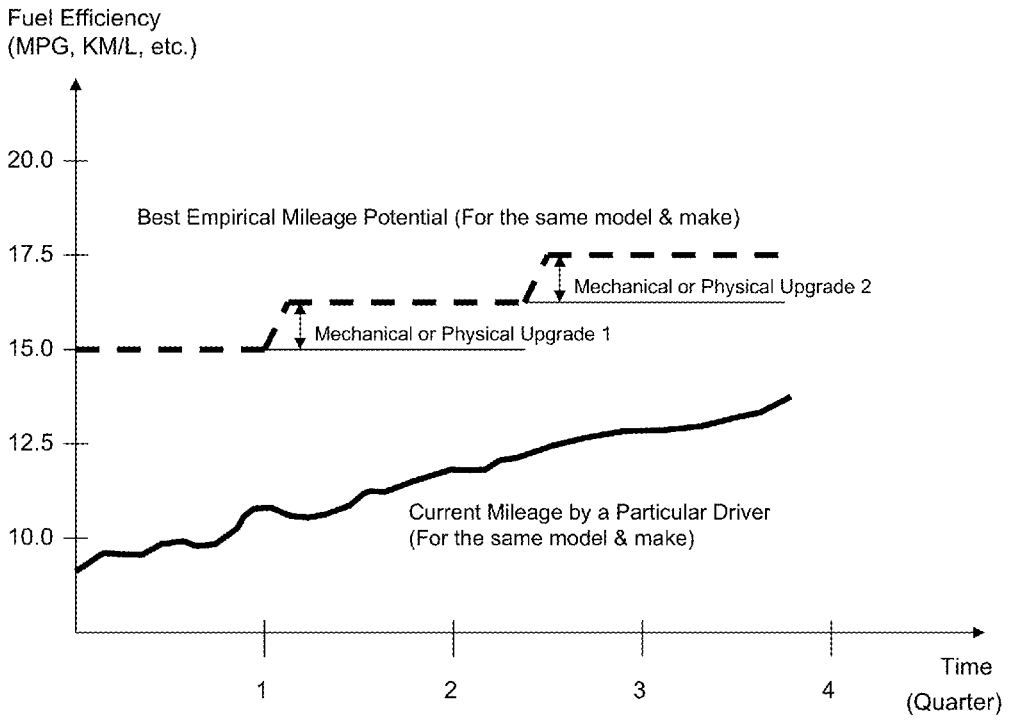
FIG. 6 shows an example of improved fuel economy in a commercial vehicle relative to time when the novel fuel savings scoring system with the remote real-time vehicle onboard diagnostics monitoring is utilized, in accordance with an embodiment of the invention.

FIG. 6 shows an exemplary graph (600) of improved fuel economy in a commercial vehicle relative to time when the novel fuel savings scoring system with the remote real-time vehicle onboard diagnostics monitoring is utilized, in accordance with an embodiment of the invention. As shown in the exemplary graph (600), the best empirical mileage potential for the same model and make can be improved with one or more rounds of mechanical or physical aftermarket upgrades to each commercial vehicle in a commercial vehicle fleet. Graphically, the best empirical mileage potential improvement is equivalent to raising an upper ceiling of realistically-achievable fuel efficiency by commercial vehicles.

On the other hand, the exemplary graph (600) also shows how the current fuel mileage by a particular driver of a commercial vehicle can be improved over time, as the particular driver is able to constantly check his or her "driving score" calculated by the fuel savings scoring system with the remote real-time vehicle onboard diagnostics monitoring, after which the particular driver is able to optimize, adjust, and change driving habits and/or utilize more fuel-efficient traffic and environmental conditions. As previously discussed for FIG. 4, the particular driver is able to improve fuel efficiency by controlling at least a portion of the non-mechanical improvement factors, while the commercial vehicle fleet organization is able to raise the upper ceiling of realistically-achievable fuel efficiency in its commercial vehicles by controlling at least a portion of the mechanical and physical improvement factors. When both efforts are combined synergistically by commercial vehicle drivers and their commercial vehicle fleet organization, the real-life fuel economy of commercial vehicles can be dramatically improved, as suggested and shown by the exemplary graph (600).

Various embodiments of the present invention provide several key advantages to conventional attempts of fuel savings in commercial fleet vehicles. One advantage of an embodiment of the present invention is providing a novel electronic system that enables a commercial vehicle operator to track, manage, and improve fuel efficiency of its fleet vehicles in operation with a centralized electronic infrastructure, which gives the commercial vehicle operator and vehicle drivers a detailed and real-time understanding of potential fuel efficiency improvement factors.

Furthermore, another advantage of an embodiment of the present invention is providing a novel electronic system that enables each commercial vehicle driver to understand a vehicle's current fuel efficiency relative to peer vehicles, and improve the fuel efficiency of commercial vehicles by optimizing driving events, habits, and behaviors.

Moreover, an additional advantage of an embodiment of the present invention is providing a fuel savings scoring system and a novel metric called the "driving score" for measuring a driver's fuel efficiency driving performance relative to the best of the driver's peers under a similar route and a similar traffic condition.

In addition, another advantage of an embodiment of the present invention is providing a novel graphical representation of the fuel savings progress to motivate both commercial vehicle operating entities and commercial vehicle drivers to improve fleet vehicle fuel efficiencies through mechanical improvement factors as well as non-mechanical improvement factors.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A fuel savings scoring system with a remote real-time vehicle on-board diagnostics monitoring, the fuel savings scoring system comprising:

a vehicle on-board diagnostics (OBD) device connected to an engine control unit or a vehicular control chipset of a vehicle, wherein the vehicle OBD device records and diagnoses engine, vehicle dynamics, and fuel consumption data and subsequently generates a real-time data stream that incorporates vehicle diagnostic data;

a commercial vehicle fuel consumption analytics module that receives the real-time data stream from the vehicle OBD device, separates mechanical and physical fuel improvement factors from non-mechanical fuel improvement factors to track and analyze these two factors independently, and generates a two-factor graph comprising a dynamically-raisable best empirical mileage potential ceiling associated with a mechanical and physical upgrade and a current fuel mileage achieved by a particular driver of the vehicle, wherein the commercial vehicle fuel consumption analytics module further receives highest empirical mileage data for an identical travel path and an identical traffic congestion level achieved by the vehicle itself or a peer vehicle of same model and make from a commercial fleet fuel consumption database associated with a commercial vehicle fleet company;

a fuel savings score analytics unit in the commercial vehicle fuel consumption analytics module, wherein the fuel savings score analytics unit calculates a travel path and traffic congestion level-specific driving score by dividing the current fuel mileage of the vehicle for the identical travel path and the identical traffic congestion level by a highest empirical mileage number for the identical travel path and the identical traffic congestion level achieved by the vehicle itself or by the peer vehicle of same model and make, and then multiplying by 100;

the commercial fleet fuel consumption database that accumulates, stores, and categorizes fuel consumption records downloaded from the vehicle and a plurality of peer vehicles of same model and make; and a computer server or another electronic device with a CPU and a memory unit that executes the fuel savings score analytics unit and utilizes the commercial fleet fuel consumption database, wherein the computer server or another electronic device displays the two-factor graph comprising the dynamically-raisable best empirical mileage potential ceiling associated with the mechanical and physical upgrade, the current fuel mileage achieved by the particular driver of the vehicle, and the travel path and traffic congestion level-specific driving score on a display panel in the vehicle or in a remote monitoring station.

2. The fuel savings scoring system of claim 1, further comprising an on-board diagnostics data transceiver unit in the vehicle and a data communication network to transmit the real-time data stream from the vehicle OBD device to the computer server or to the remote monitoring station wirelessly.

3. The fuel savings scoring system of claim 2, wherein the on-board diagnostics data transceiver unit in the vehicle requests and receives the highest empirical mileage data from the commercial fleet fuel consumption database executed by the computer server or another electronic device.

4. The fuel savings scoring system of claim 1, wherein the fuel savings score analytics unit is a software component executed by the computer server or another electronic device with the CPU and the memory unit, and wherein the fuel savings core analytics unit further comprises an onboard diagnostics device (OBD) information management module, a vehicle location and route information management module, an empirical best mileage management module for the peer vehicle of same model and make to the vehicle, a driving score calculation module, and an information display management module for calculating the travel path and traffic congestion level-specific driving score.

5. The fuel savings scoring system of claim 1, wherein the commercial vehicle fuel consumption analytics module is a vehicle-side module, a computer server-side module, or both.

6. The fuel savings scoring system of claim 1, further comprising a vehicle location and route information management module that correlates the highest empirical mileage data achieved by the vehicle itself or the peer vehicle of same model and make to vehicle routes and traffic conditions when each data point was recorded for the vehicle and the peer vehicle.

7. The fuel savings scoring system of claim 6, wherein the highest empirical mileage number achieved by the vehicle itself or by the peer vehicle of same model and make, for calculation of the travel path and traffic congestion level-specific driving score of the vehicle, is adjusted for the vehicle routes and traffic conditions when each data point was recorded for the peer vehicle.

8. The fuel savings scoring system of claim 1, further comprising an information display management module for generating graphical data to display the travel path and traffic congestion level-specific driving score on the display panel in the vehicle or in the remote monitoring station.

9. The fuel savings scoring system of claim 1, wherein the vehicle is a truck, a taxi, a van, or another commercial vehicle.

10. The fuel savings scoring system of claim 1, wherein the travel path and traffic congestion level-specific driving score informs a driver of the vehicle to utilize non-mechanical improvement factors to improve an overall operating fuel efficiency of the vehicle.

11. The fuel savings scoring system of claim 1, wherein the travel path and traffic congestion level-specific driving score informs the commercial vehicle fleet company to utilize mechanical and physical improvement factors to improve an overall operating fuel efficiency of the vehicle.

12. The fuel savings scoring system of claim 1, wherein fuel savings score analytics unit in the commercial vehicle fuel consumption analytics module also calculates and keeps track of travel path and traffic congestion level-specific driving score trends over a day, a week, a month, a year, or another set period of time.

* * * * *